US005531213A

United States Patent [19]

Berlaimont

[11] Patent Number: 5,531,213

[45] Date of Patent: Jul. 2, 1996

[54] SOLID OR LIQUID FUEL STOVE

[75] Inventor: Claude Berlaimont, Falisolle, Belgium

[73] Assignees: Fonderies Du Lion S.A., Frasnes-lez-Couvin; Nestor Martin S.A., Brussels, both of Belgium

[21] Appl. No.: 394,581

[22] Filed: Feb. 27, 1995

[30] Foreign Application Priority Data

Feb. 25, 1994 [BE] Belgium ..... 09400220

[51] Int. Cl.[6] ..... F23M 7/00; F24C 15/04

[52] U.S. Cl. ..... 126/193; 126/200

[58] Field of Search ..... 126/193, 198, 126/200, 77, 112, 190

[56] References Cited

U.S. PATENT DOCUMENTS

| | | | |
|---|---|---|---|
| 4,329,930 | 5/1982 | Riley | 126/193 |
| 4,404,953 | 9/1983 | Thulman et al. | 126/193 |
| 4,683,868 | 8/1987 | Ferguson | 126/193 |
| 4,766,876 | 8/1988 | Henry et al. | 126/193 |

*Primary Examiner*—James C. Yeung
*Attorney, Agent, or Firm*—Spencer & Frank

[57] ABSTRACT

A stove comprises a combustion chamber and a window disposed at the front wall of the combustion chamber. The stove further includes a device disposed at the front wall of the combustion chamber for directing air into the combustion chamber across the inner side of the window and in a downward direction. The device can form, across the inner side of the window, a screen of air which has a width approximately equal to the width of the window. The device includes a longitudinal chamber and a longitudinal slot in flow communication with the longitudinal chamber. Disposed within the slot are: a cylindrical register which can be rotated about its longitudinal axis for controlling a flow amount of the screen of air across the window; a profiled piece having air passage openings therein; and a flexible sealing leaf engaging, on one side thereof, the cylindrical register, and on another side thereof, the profiled piece. The sealing leaf has air passage openings therein, the air passage openings of the profiled piece being situated between the air passage openings of the sealing leaf and the back wall of the longitudinal slot, such that air being aspirated from the outside of the combustion chamber flows through the longitudinal slot by flowing, respectively, through the register, through the air passage openings of the sealing leaf, and through the air passage openings of the profiled piece to the longitudinal chamber, and from the longitudinal chamber across the window.

7 Claims, 3 Drawing Sheets

SOLID OR LIQUID FUEL STOVE

This invention relates to a solid or liquid fuel stove comprising a combustion chamber equipped on its front side with a window made from transparent material allowing to observe the flames.

SUMMARY OF THE INVENTION

An object of the invention is to create conditions such that distillates from the combustion chamber which have not yet been burnt, are prevented from being deposited onto the window.

A further object of the invention is to improve the combustion conditions in the combustion chamber by providing a secondary source of superheated air — proportional to the primary source of air — directly introduced in a postcombustion zone.

In order to achieve this objective in conformity with the invention, the front side of the combustion chamber is equipped with means for directing an air draught caught at the outside of the stove downwards along the inner side of the window into the combustion chamber in the form of a screen having approximately the width of the window.

According to the invention, a stove comprises a combustion chamber and a window disposed at teh front wall of the combusion chamber. The stove includes a device disposed at the front wall of the combustion chamber for directing air into the combustion chamber across the inner side of the window and in a downward direction. The device can form, across the inner side of the window, a screen of air which has a width approximately equal to the width of the window. The device includes a longitudinal chamber and a longitudinal slot in flow communication with the longitudinal chamber. Disposed within the slot are: a cylindrical register which can be rotated about its longitudinal axis for controlling a flow amount of the screen of air across the window; a profiled piece having air passage openings therein; and flexible sealing leaf engaging, on one side thereof, the cylindrical register, and on another side thereof, the profiled piece. The sealing leaf has air passage openings therein, the air passage openings of the profiled piece being situated between the air passage openings of the sealing leaf and the back wall of the longitudinal slot, such that air being aspirated from the outside of the combustion chamber flows through the longitudinal slot by flowing, respectively, through the register, through the air passage openings of the sealing leaf, and through the air passage openings of the profiled piece to the longitudinal chamber, and from the longitudinal chamber across the window.

In an advantageous embodiment, at least one, but preferably two pipes are connected to the longitudinal chamber, the pipes being directed to a center of the stove where the combustion smokes come together.

Other details and advantages will become apparent from the following description of a solid or liquid combustion stove according to the invention. This description is only given by way of example and does not limit the invention.

BRIEF DESCRIPTION OF THE DRAWINGS

Further features and details of the present invention will become evident from the description below of depictions thereof that are illustrated in the drawings, in which.

DETAILED DESCRIPTION OF THE INVENTION

Figure 4:
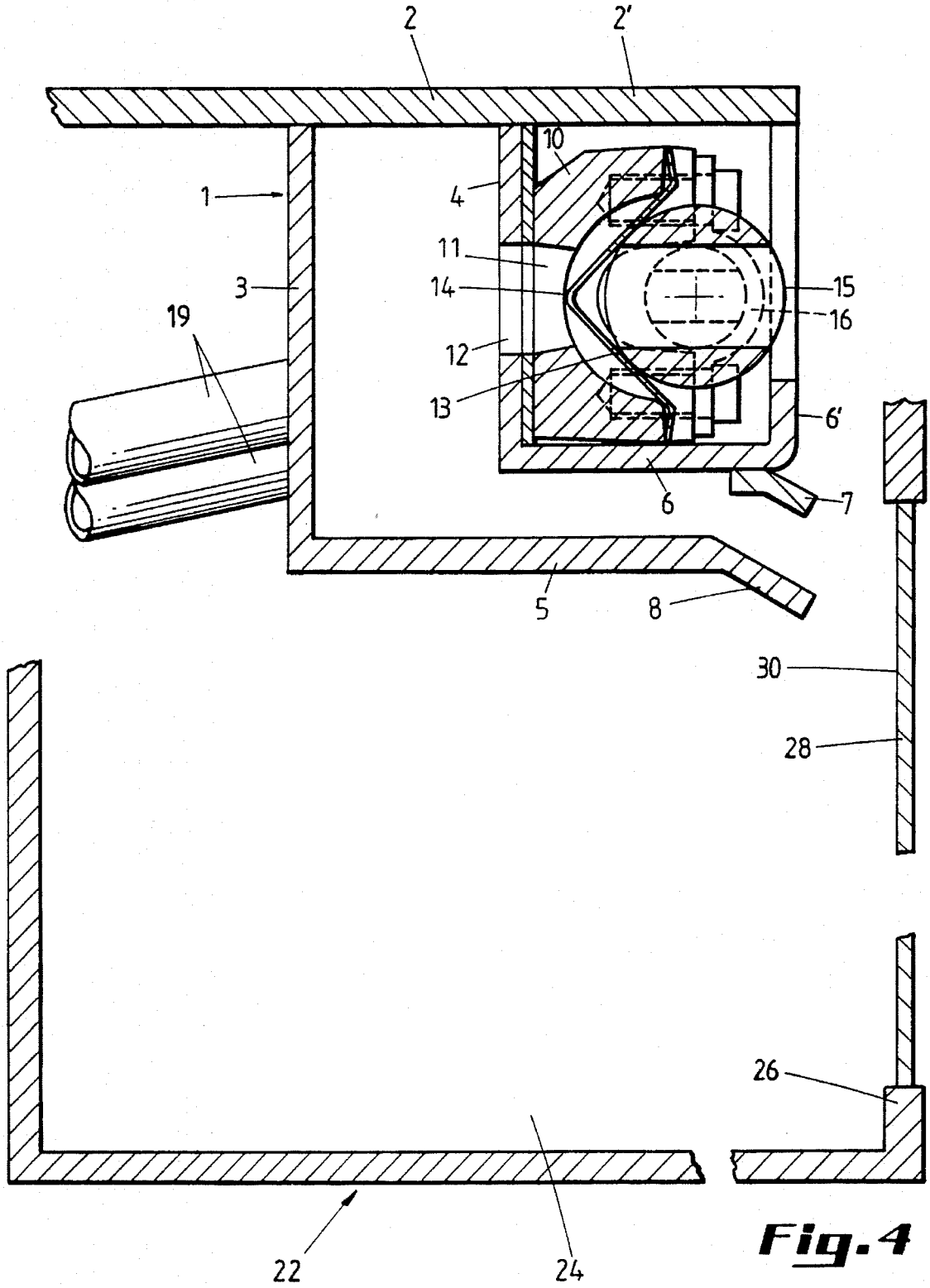
FIG. 4 shows the longitudinal chamber of FIG. 3 provided with two pipes directing air to the center of the stove and disposed at the front wall of a combustion chamber.

The stove 22 includes elements which prevent smoke and vapor from being deposited onto the transparent window 28 equipping the front side of front wall 26 of the stove, as shown in FIG. 4. The stove is fed with solid or liquid fuel. The invention is more particularly applicable to wood stoves.

Such a type of stove has a combustion chamber, and four walls. The front wall of the stove is equipped with a window made from transparent material. This window should ideally be kept in a perfect state, i.e. without impurities due to the smokes and present in the combustion chamer. The reason for the above is that the maintenance of this glazed window is generally not possible since the temperature of the window is high.

It is possible to obviate the drawbacks above described by keeping a combustion air flow circulating over the entire width of the inner side 30 of the window and, in downward direction due to gravity.

According to the invention, as shown in FIG. 4, the front wall of the stove is equipped with a longitudinal chamber 1 delimited at its upper side by a plate 2 and two vertical walls 3 and 4. At its bottom, the longitudinal chamber 1 is delimited by a lower plate 5. A wing 6 extending at right angles with respect to the vertical wall 4 is folded at its end in the form of a flange 6'. This flange is situated substantially in the plane of the front wall of the stove.

Figure 1:
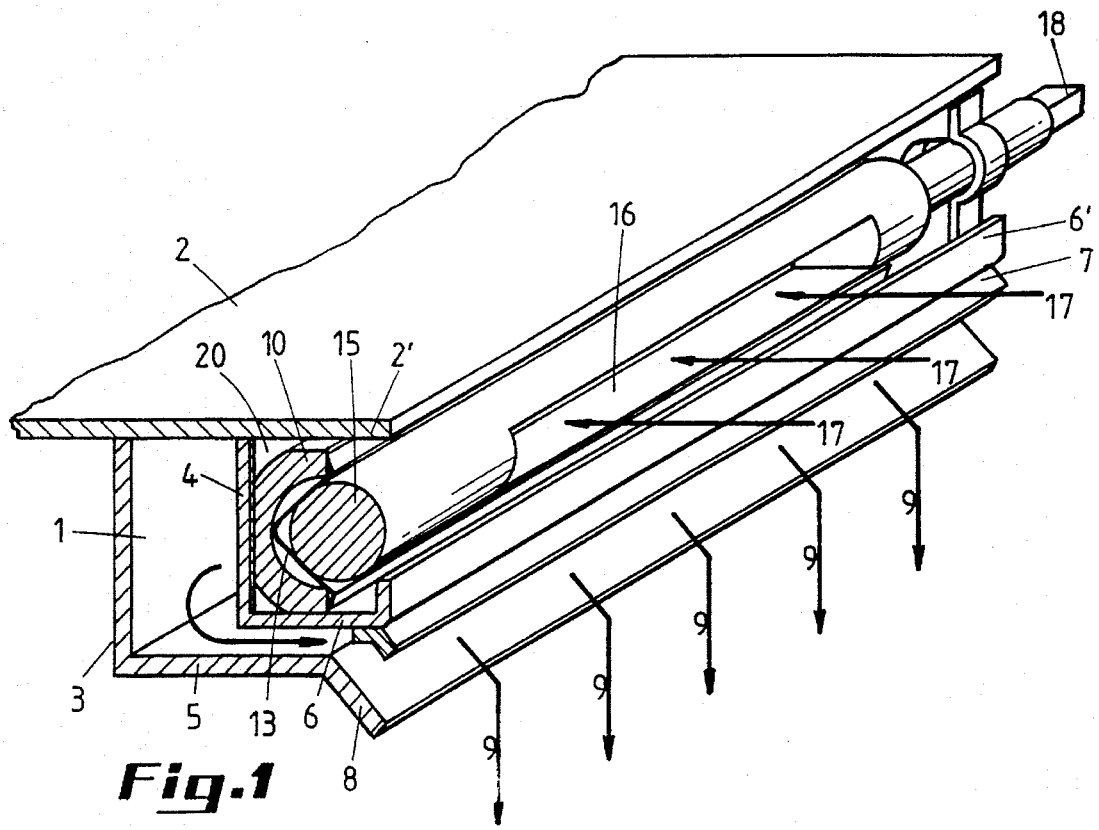
FIG. 1 is a perspective view of the longitudinal chamber equipped with the register according to the invention.

Under the flange 6' is a piece 7 folded toward the bottom so as to form together with the folded front part 8 of the plate 5 a longitudinal passage 20 which allows the combustion air to be directed in a thin layer of screen along the glazed window of the stove in the direction of arrows 9 shown in FIG. 1.

Combustion air is supplied from the outside of the combustion chamber in the direction of chamber 1 through elements which will be described below.

Housed between wing 2' which extends towards the front side,of the stove plate 2 and wing 6 is an arcuate or folded profiled piece 10 showing air passage openings 11, openings 11 are adapted to be situated opposite the passage openings 12 provided in the wall 4 of chamber 1, when piece 10 is mounted between wings 2' and 6.

Figure 2:
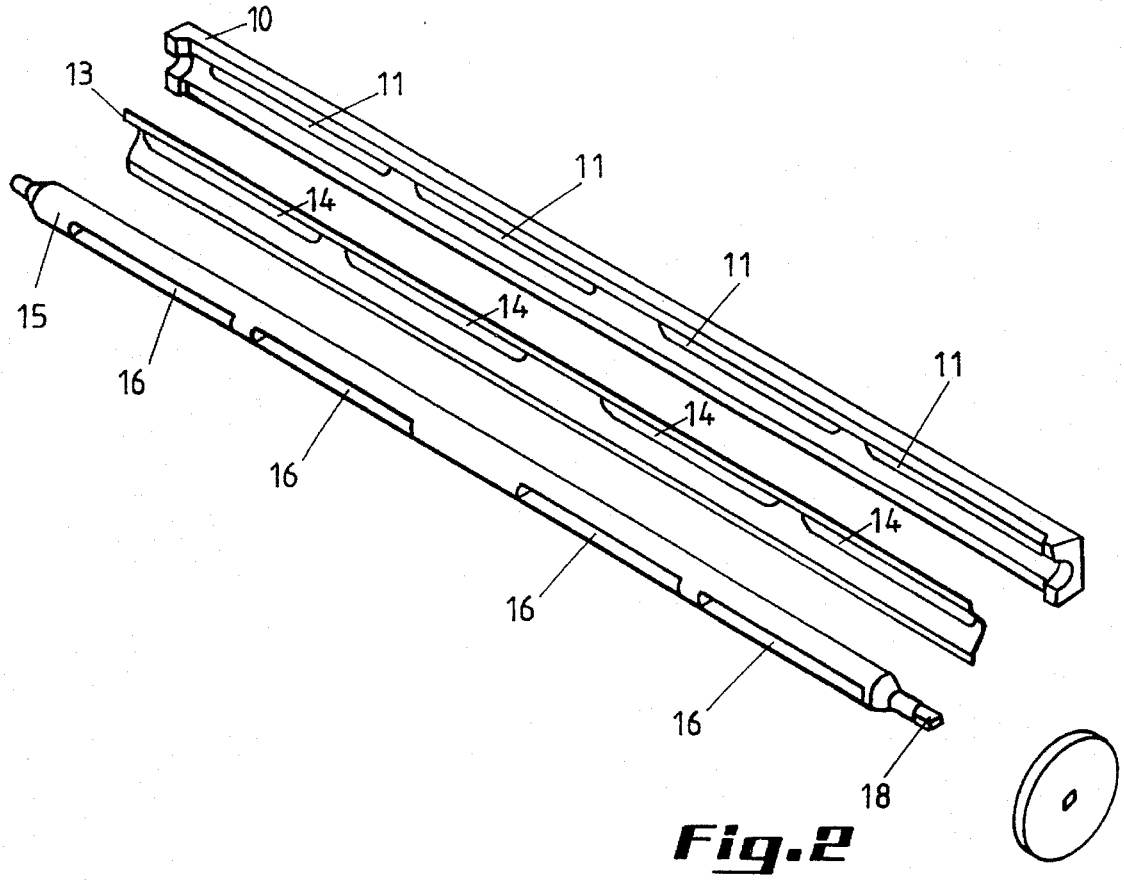
FIG. 2 is an exploded view showing the elements cooperating with the register according to the invention.
Figure 3:
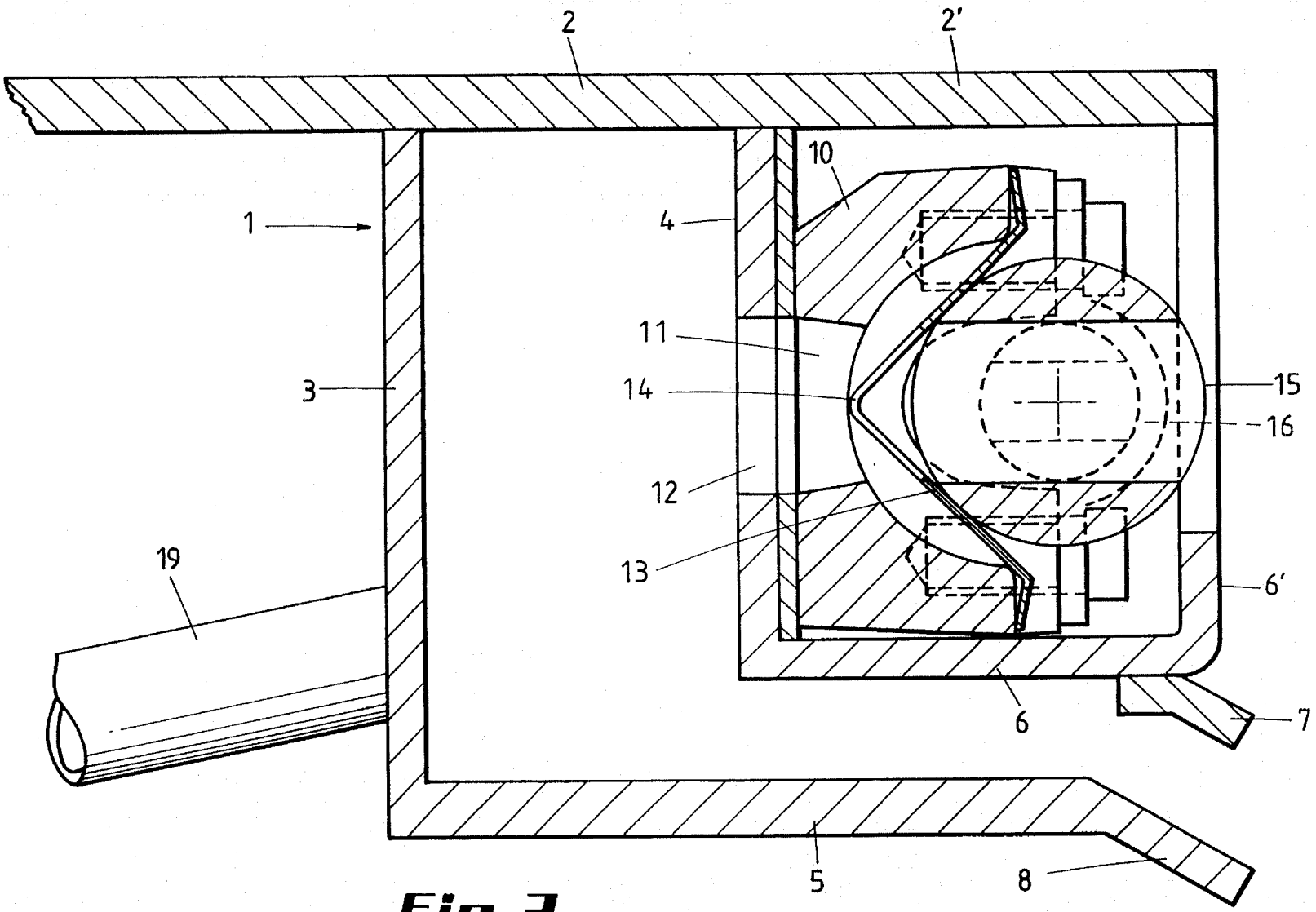
FIG. 3 shows on a larger scale a transverse cross section through the longitudinal chamber with its register and a pipe connected to the longitudinal chamber.

In FIG. 2, the different slots and passage openings are clearly shown.

A sealing leaf 13, for example of stainless steel, engages the arcuate or folded profiled piece 10. The leaf includes combustion air passage openings 14.

Finally, a cylindrical register 15 is mounted in front of and in close contact with the sealing leaf 13. The cylindrical register 15 includes over a large portion of its length several passage openings 16 which ensure entry of combustion air in the direction of the passage openings provided in the resilient leaf 13, arcuate or folded piece 10 and wall 4 of chamber 1.

By rotating the cylindrical register 15 around its axis, the volume of air entering chamber 1, and from there flowing toward the glazed window according to the flow path represented by the arrows 9, can be varied to a large extent. The entry of air in the cylindrical register 15 is suggested by arrows 17.

Rotating the cylindrical register 15, i.e. recycling the air entering longitudinal chamber 1 and from there flowing along the inner wall of the glazed window, is done by actuating the end 18 which protrudes laterally out of the cylindrical register 15.

Due to the presence of the resilient leaf 13 and thanks to its close contact with the cylindrical register 15, it is possible to control the flow rate of air entering into longitudinal chamber 1 very accurately. This flow rate can moreover be closed off completely, permitting safe use of anthracitic fuels.

According to the invention, use is made of the longitudinal chamber 1 to connect two or more pipes 19 thereto which are directed in such a manner that secondary superheated air can reach the center of the stove and participate in the postcombustion phenomenon indispensable for increasing the degree of total combustion of gases within the combustion chamber, as shown in FIG. 4.

It will be understood that the above description of the present invention is susceptible to various modifications, changes and adaptations, and the same is intended to be comprehended within the meaning and range of equivalents of the appended claims.

What is claimed is:

1. A stove comprising:

a combustion chamber having a front wall;

a window made from transparent material disposed at the front wall of the combustion chamber for allowing observation of flames inside the combustion chamber, the window having an inner side and a width; and means disposed at the front wall of the combustion chamber for directing air from a region outside of the combustion chamber into the combustion chamber across the inner side of the window and in a downward direction, the means for directing being effective for forming, across the inner side of the window, a screen of air which has a width approximately equal to the width of the window, the means for directing further having a first region adjacent the front wall of the combustion chamber, and a second region separated from the front wall of the combustion chamber by the first region, the means for directing including:

(a) a plurality of walls defining a longitudinal chamber therebetween, the longitudinal chamber being disposed at the second region and having a length;

(b) a back wall and two mutually parallel wings defining at least one longitudinal slot therebetween, the longitudinal slot being disposed at the first region and being in flow communication with the longitudinal chamber, the parallel wings further having free edges configured to extend substantially into a plane defined by the front wall of the combustion chamber;

(c) a cylindrical register disposed within the longitudinal slot, the register including a longitudinal axis, and being adapted to rotate about its longitudinal axis for controlling a flow amount of the screen of air across the window by adjustably obturating air flow across the longitudinal slot, the register further being configured such that the screen of air across the window has a homogeneous thickness;

(d) a profiled piece disposed in the longitudinal slot and having air passage openings therein, the profiled piece further being one of folded and arcuate; and (e) a flexible sealing leaf engaging, on one side thereof, the cylindrical register, and on another side thereof, the profiled piece, the sealing leaf further having air passage openings therein, the air passage openings of the profiled piece being situated between the air passage openings of the sealing leaf and the back wall of the longitudinal slot, such that air being aspirated from the outside of the combustion chamber flows through the longitudinal slot by flowing, respectively, through the register, through the air passage openings of the sealing leaf, and through the air passage openings of the profiled piece to the longitudinal chamber, and from the longitudinal chamber across the window.

2. The stove according to claim 1, wherein the means for directing further includes a first piece and a second piece cooperating with the first piece for defining a longitudinal passage therebetween, the longitudinal passage extending along the length of the longitudinal chamber at a bottom region thereof, the second piece further including a free end bent in a downward direction for directing air from the longitudinal chamber across the window.

3. The stove according to claim 1, further including at least one pipe connected to at least one of the plurality of walls defining the longitudinal chamber, the pipe being configured to direct air to a center region of the combustion chamber where combustion smokes converge.

4. The stove according to claim 3, wherein the at least one pipe includes two pipes.

5. The stove according to claim 1, wherein the plurality of walls defining the longitudinal chamber include two wings extending toward the front wall of the combustion chamber, the longitudinal slot being disposed in between the two wings.

6. The stove according to claim 1, wherein the back wall of the longitudinal slot includes air passage openings therein effective for establishing air flow from the air passage openings of the profiled piece to the longitudinal chamber.

7. the stove according to claim 1, wherein the register includes air passage openings therein through which air is aspirated from the outside region of the combustion chamber.

* * * * *